US005390484A

United States Patent [19]

Schwalm

[11] Patent Number: 5,390,484

[45] Date of Patent: Feb. 21, 1995

[54] SLIVER CAN TRANSPORT CARRIAGE AND METHOD FOR AUTOMATIC SLIVER CAN EXCHANGE OPERATIONS

[75] Inventor: Hans-Werner Schwalm, Moenchengladbach, Germany

[73] Assignee: W. Schlafhorst AG & Co., Moenchengladbach, Germany

[21] Appl. No.: 922,815

[22] Filed: Jul. 31, 1992

[30] Foreign Application Priority Data

Jul. 31, 1991 [DE] Germany ..... 4125383

[51] Int. Cl.[6] ..... D01H 9/10; D01H 13/02

[52] U.S. Cl. ..... 57/281; 19/159 A; 57/90; 57/268

[58] Field of Search ..... 57/90, 266, 268, 270, 57/281; 19/159 A

[56] References Cited

U.S. PATENT DOCUMENTS

| | | | |
|---|---|---|---|
| 4,150,534 | 4/1979 | Raasch | 57/281 |
| 4,537,018 | 8/1985 | Tooka | 57/266 X |
| 4,735,040 | 4/1988 | Pircher | 57/266 |
| 4,998,406 | 3/1991 | Raasch | 57/276 X |
| 5,138,828 | 8/1992 | Stanlecker | 57/90 X |
| 5,158,417 | 10/1992 | Siegenthaler et al. | 414/539 |

FOREIGN PATENT DOCUMENTS

| | | | |
|---|---|---|---|
| 360023 | 3/1990 | European Pat. Off. | 19/159 A |

*Primary Examiner*—Daniel P. Stodola
*Assistant Examiner*—William Stryjewski
*Attorney, Agent, or Firm*—Shefte, Pinckney & Sawyer

[57] ABSTRACT

A method for automatic silver can exchange operations includes the transport of full sliver cans on a sliver can transport carriage to and between the spinning stations of a textile spinning machine and is particularly suitable for the exchange of sliver cans at spinning stations of the type having a back row position for supporting a sliver can and a front row position for supporting another sliver can. In a situation in which sliver is still being drawn from the frontmost sliver can while the backmost sliver can is empty, the method includes the step of initially transferring the running sliver can to the transport carriage, positioning a can support on the transport carriage for receipt of the empty backmost sliver can, and transfer of the empty backmost sliver can. Thereafter, the method includes the step of indexing movement of a full sliver can on the transport carriage to position the can for subsequent transfer to the back row position of the spinning station. Following transfer of the full sliver can from the transport carriage to the back row position of the spinning station, the running sliver can is returned to the front row position of the spinning station. An apparatus for use in practicing the method includes a can transport carriage having a rotating turntable with a plurality of equally angularly spaced can supports thereon.

14 Claims, 7 Drawing Sheets

SLIVER CAN TRANSPORT CARRIAGE AND METHOD FOR AUTOMATIC SLIVER CAN EXCHANGE OPERATIONS

BACKGROUND OF THE INVENTION

The present invention relates to a sliver can transport carriage and a method for automatic sliver can exchange operations and, more particularly, to a sliver can transport carriage for supplying full sliver cans to the spinning stations of a spinning machine and transporting empty sliver cans from the spinning stations and a method for the supplying of full sliver cans.

U.S. Pat. No. 4,998,406 to Raasch discloses a sliver can transport carriage having a rotating table for supporting thereon a plurality of sliver cans in respective can supports. The can transport carriage transports a plurality of full sliver cans to a transfer position adjacent the spinning station of a spinning machine and the table rotates to sequentially bring each full sliver can supported on the can transport carriage into position for subsequent transfer to the spinning station. The can transport carriage receives empty sliver cans from the spinning station for subsequent transport of these empty sliver cans to a sliver can refill location.

Although the sliver can transport carriage disclosed in the Raasch '406 patent provides efficient transport of full sliver cans to the spinning stations of a spinning machine, the prior art transport carriage is probably best adapted to supply full sliver cans to those types of spinning stations having only a single row of sliver cans—e.g., each spinning station supports a single sliver can intermediately between the longitudinal edge of the spinning machine along which the transport carriage travels and the frame of the spinning station itself. However, in another known configuration of a spinning station of a textile spinning machine, each spinning station includes two rows of sliver cans—e.g., a first sliver can in a back row position and a second sliver can in a front row position laterally intermediate the first sliver can in the back row position and the longitudinal edge of the textile spinning machine. At a spinning station of this other known configuration, sliver may be continuously drawn from both sliver cans and factors such as differing start times and breakages almost invariably lead to a situation in which the sliver in one of the two sliver cans at a spinning station is fully drawn out from its respective sliver can before the other sliver has been fully drawn out from its respective sliver can.

In the event that the sliver can in the front row position has its sliver depleted first, a sliver can transport carriage such as the Raasch '406 transport carriage can efficiently exchange this empty sliver can for a full sliver can. However, if the sliver can in the back row position is depleted first while sliver continues to be drawn out of the other sliver can in the front row position, special arrangements must be made to access the empty sliver can in the back row position such as, for example, an arrangement in which a rotating table is provided at the spinning station to permit selective alternating movement of the sliver cans between the front and back row positions. Thus, the need exists for improvements in the methods for exchanging sliver cans at spinning stations of a textile spinning machine of the type having sliver cans in two or more rows. Also, the need exists for improvements in an apparatus for facilitating such sliver can exchange methods.

SUMMARY OF THE INVENTION

Briefly described, the present invention provides, in one aspect thereof, an apparatus for transporting full sliver cans to the spinning station of a textile spinning machine for exchange of full sliver cans for empty sliver cans at the spinning stations, the textile spinning machine having a longitudinal edge along which the spinning stations are serially located and the spinning stations each having a back row position for supporting a sliver can and a front row position for supporting another sliver can laterally intermediate the back row position of the spinning station and the longitudinal edge of the textile spinning machine. The apparatus includes a can transport carriage movable to and between the spinning stations, the can transport carriage including means forming a plurality of can supports, each for supporting a sliver can thereon and one of the can supports for supporting a running sliver can from which sliver continues to be drawn. Also, the can transport carriage includes means for indexing movement of at least some of the can supports to sequentially position each indexed can support at a can transfer location at which a can is transferred between the can support and the textile spinning machine during a can exchange operation. The can transport carriage also includes means for transferring a sliver can from at least a selected one of the front and back row positions at a spinning station to the can transport carriage, the running can support being operable to support a running sliver can transferred to the transport carriage for the continuous drawing of sliver from the running sliver can during a can exchange operation in which a full sliver can supported on the can transport carriage is transferred to a spinning station.

According to one preferred feature of the one aspect of the present invention, the can supports forming means includes means forming three can supports at equal angular spacings of 120° from one another relative to an axis transverse to the direction of travel of the can transport carriage and its lateral extent and the indexing movement means includes means for rotating the three equally angularly spaced can supports about the axis. Preferably, the running can support is disposed in front of the other can supports relative to the direction of travel of the can transport carriage.

According to another preferred feature of the one aspect of the present invention, the apparatus includes a can manipulating assembly having a selectively extendable and retractable frame and a pair of gripping elements mounted to the frame for gripping a sliver can, at least one of the gripping elements being movable between a can gripping position in which it cooperates with the other gripping element to grip a sliver can and a can release position in which it cooperates with the other gripping element to release a gripped sliver can, the frame being extendable in a direction generally transverse to the direction of travel of the can transport carriage to position the gripping elements laterally outwardly of one side of the transport carriage for selective release or gripping of a sliver can. For can exchange operations in which each sliver can includes an upper circumferential bead of a greater radius than the body of the sliver can, the can manipulating assembly preferably includes means for moving the ends of the gripping elements to respective circumferentially spaced positions radially inwardly of and below the upper bead of a sliver can and for raising the gripping elements to thereby lift the sliver can.

In the another preferred feature of the one aspect of the present invention, the can manipulating assembly may optionally include means for extending the frame laterally outwardly of the transport carriage on a side thereof opposite the one side for selectively gripping of a sliver can by the gripping elements supported at a sliver can loading location or releasing a sliver can onto the sliver can loading location and for retraction of the frame to a position in which the gripping elements are operable to selectively grip a sliver can supported on a can support or release a sliver can onto a can support.

According to a further preferred feature of the one aspect of the present invention, the can transport carriage includes an assembly for shifting a sliver can between the running can support and the respective can support at the can transfer location. Also, according to yet another preferred feature of the one aspect of the present invention, the can transport carriage includes means for guiding sliver being drawn from a running sliver can supported at the running can support, the guiding means guiding the sliver to travel in a predetermined path between the can transport carriage and the spinning station.

In yet an additional aspect of the one aspect of the present invention, the can transport carriage includes a centerline, the can transfer location is located to one lateral side of the centerline and the running can support is located laterally of the centerline to the same lateral side as the can transfer location.

According to another aspect of the present invention, there is provided a method of exchanging a sliver can at a spinning station of a textile spinning machine for a full sliver can transported to the spinning station by a sliver can transport carriage, the sliver can transport carriage traveling longitudinally along the one longitudinal edge of the textile spinning machine and the spinning station including a back row position for supporting a first sliver can and a front row position for supporting a second sliver can laterally intermediate the back row position and the longitudinal edge of the textile machine. The method includes transferring a running sliver can from the front row position of the spinning station to the sliver can transport carriage without interruption of the drawing of sliver therefrom and transferring a sliver can from the back row position of the spinning station to the sliver can transport carriage. Also, the method includes transferring a full sliver can from the sliver can transport carriage to the back row position of the spinning station and returning the running sliver can transferred from the front row position to the front row position.

DESCRIPTION OF THE PREFERRED EMBODIMENT

Figure 1:
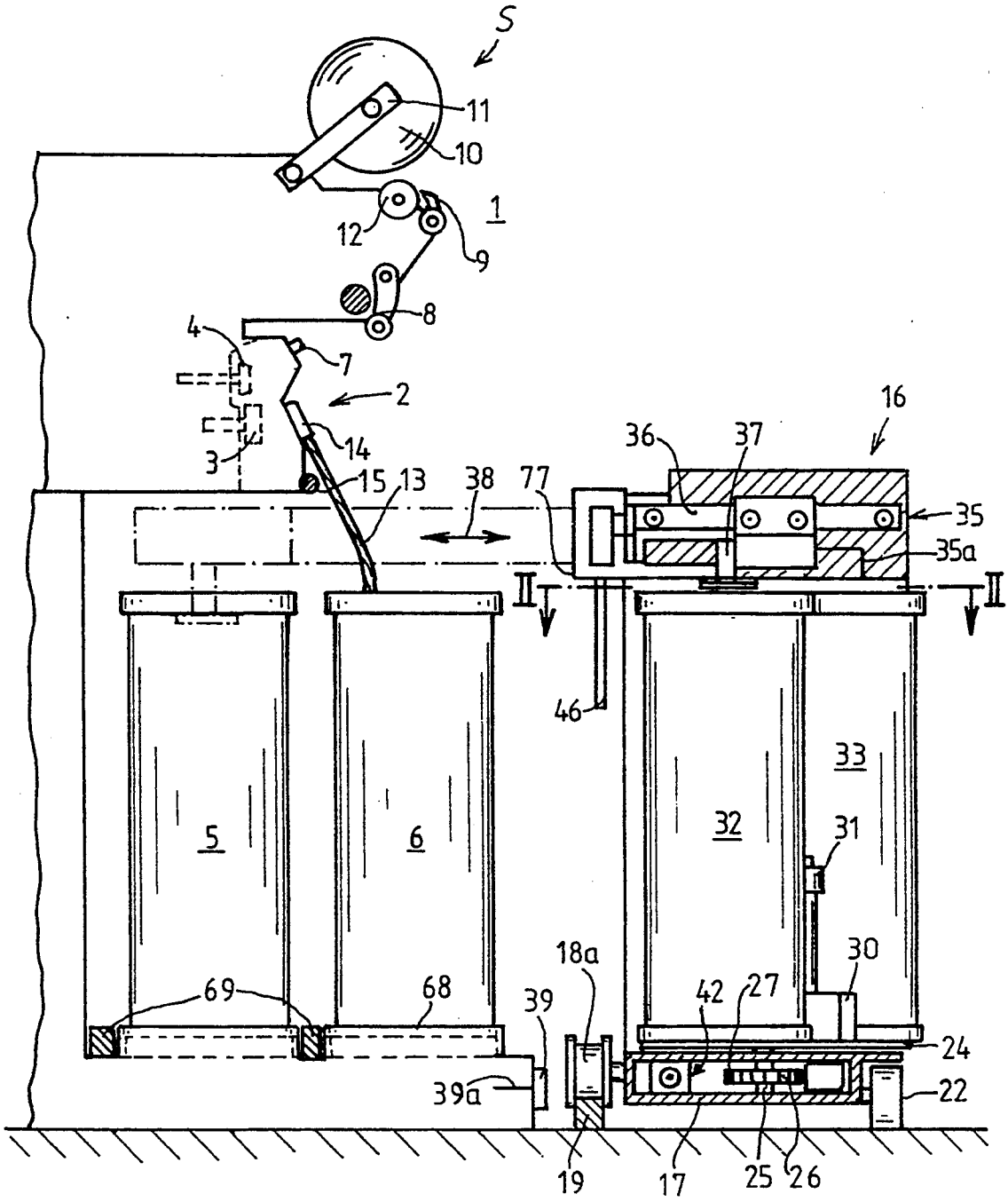
FIG. 1 is a side elevational view of a spinning station of a textile spinning machine and, in partial vertical section, of the preferred embodiment of the sliver can transport carriage of the present invention in its operating position adjacent the spinning station.

As seen in FIGS. 1–10, the preferred embodiment of the sliver can transport carriage 16 of the present invention is operable to supply full sliver cans to a textile spinning machine such as, for example, an open end spinning machine S having a plurality of spinning stations 1. As seen in FIG. 1, each spinning station 1 of the open end spinning station S includes a spinning box 2 having an opening device 3 and a rotor 4. The spinning box 2 draws in sliver from a sliver can, such as a sliver can 5 positioned below the spinning box 2. Each spinning station 1 is of the type having a back row position for supporting a sliver can (e.g., the sliver can 5 shown in FIG. 1) and a front row position for supporting a sliver can (e.g., the sliver can 6 shown in FIG. 1) laterally intermediate the back row sliver can and the longitudinal edge of the textile spinning machine.

So long as each spinning box 2 is able to draw sliver from a sliver can, the rotor 4 operates to form the sliver fibers into a strand which is continuously drawn out of the spinning box 2 through a navel 7 and sequentially traveled through a pair of draw-off rolls 8 and a yarn guide 9 onto a cross-wound package 10 rotatably supported on a cross-wound package frame 11 and rotatably driven by a friction drive roller 12. However, upon emptying of the respective sliver can feeding the spinning box 2, the drawing of a strand from the spinning box correspondingly ceases as slivers no longer available to be formed into the strand and the cross-wound package 10 is disengaged from the driving movement of the friction drive roller 12 until the spinning operation is restarted.

Figure 4:
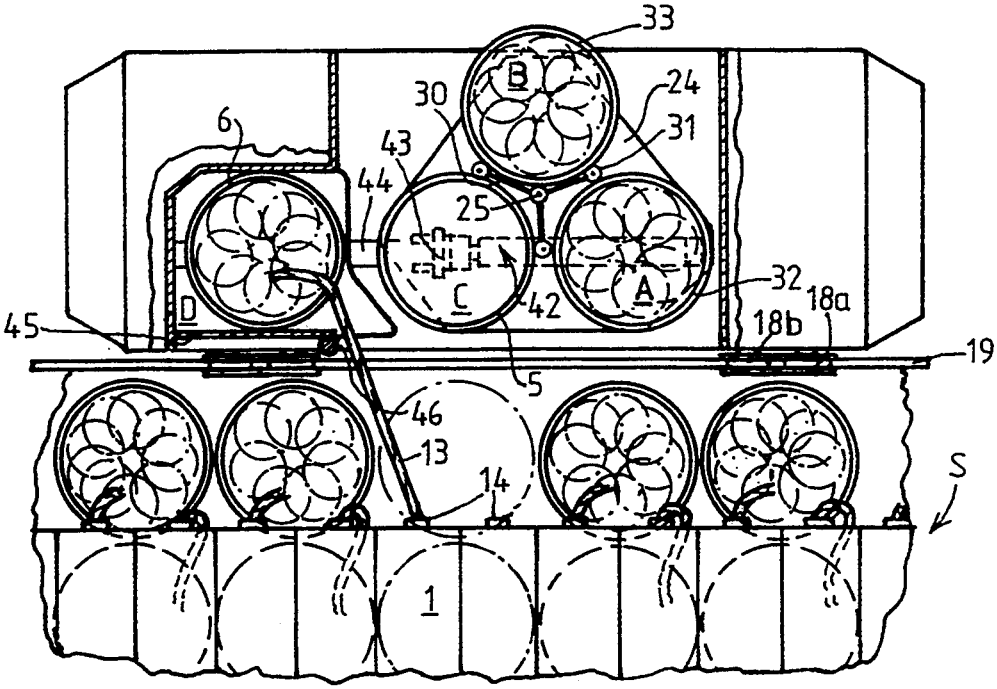
FIG. 4 is a top plan view, in partial horizontal section, of the sliver can transport carriage shown in FIG. 1 disposed in its operational position for receiving an empty sliver can from a spinning station of a textile spinning machine.

As seen in FIG. 4 in a typical spinning machine sliver feeding arrangement, a plurality of sliver cans 6 are disposed in the front row positions of the spinning stations 1 and the sliver drawn out of each sliver can 6 initially passes through a compressive intake assembly 14 supported on a shaft 15. Sliver is also drawn from a plurality of sliver can 5 disposed in the back row positions of the spinning stations. The sliver can transport carriage 16 is operable to travel to and between the spinning stations 1 to supply full sliver cans 3 thereto upon exhaustion of the sliver cans 5 or 6 already positioned at the spinning stations and to transport the exhausted or empty sliver cans 5 or 6 to another locations such as, for example, a location at which the sliver cans are refilled with sliver (not shown).

Figure 2:
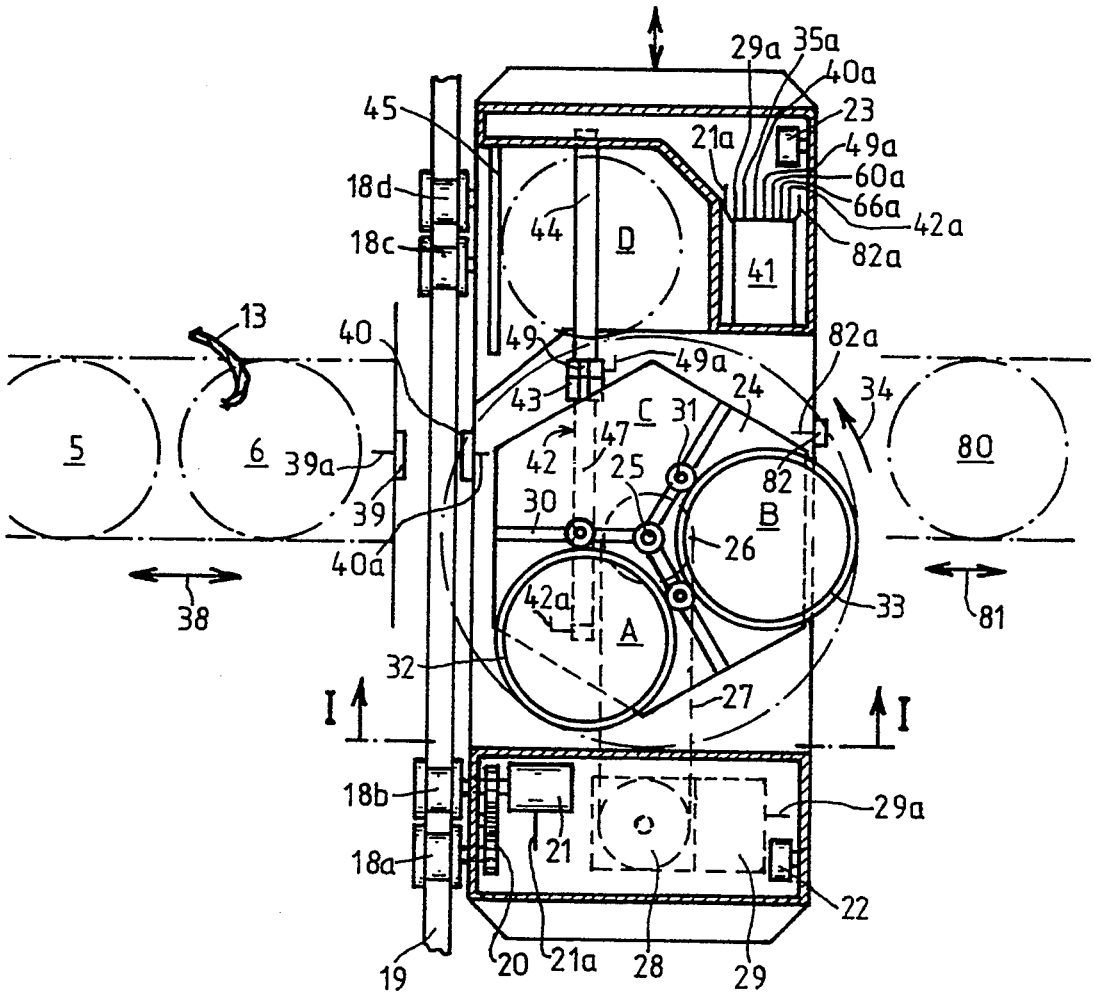
FIG. 2 is a top plan view, in partial horizontal section, of the sliver can transport carriage shown in FIG. 1.

As seen in FIG. 1, the sliver can transport carriage 16 includes an undercarriage frame 17, one side of which rotatably supports a first pair of flanged wheels 18*a*, 18*b* and a second pair of flanged wheels 18*c*,18*d* at a longitudinal spacing from the first pair of flanged wheels. As seen in FIG. 2, the two pairs of flanged wheels 18*a*,18*b* and 18*c*,18*d* are rotatably supported on the undercarriage frame 17 for rolling travel of the wheels along a guide rail 19 extending longitudinally along the lengthwise extent of the open end spinning machine S. The undercarriage frame 17 also rotatably supports a pair of smooth-surfaced wheels 22,23 for rolling support of the sliver can transport carriage 16 along a floor in cooperation with the guided rolling support of the flanged wheels 18*a*–*d* extending from the other side of the undercarriage frame 17. A drive motor 21, as seen in FIG. 2, is operatively connected via a connector 21*a* to a control unit 41 mounted on the sliver can transport carriage 16 and the drive motor 21 is operatively connected via a transmission assembly 20 to the flanged wheels 18*a*,18*b* for driving movement of the sliver can transport carriage.

As seen in FIG. 2, the sliver can transport carriage 16 includes means for supporting up to three sliver cans for simultaneous movement thereof about a vertical axis extending transversely to the longitudinal and lateral extents of the sliver can transport carriage 16 and a separate can support D for supporting a single sliver can out of interference with the simultaneously movable sliver cans. The supporting means is preferably in the form of a six-sided turntable 24 rotatably supported on a shaft 25 defining the vertical axis and the shaft 25 is co-axially mounted to a gear 26, as seen in FIG. 2. A drive gear 28 is driveably connected to the gear 26 by a drive chain 27 for driving rotation of the turntable 24 in correspondence with the rotation of the drive gear 28 by a drive motor 29, which is operatively connected via a connector 29*a* to the control unit 41.

The turntable 24 includes three supports A, B, and C at equal angular and radial spacings with respect to the shaft 25. Each support A, B, and C supports a sliver can. Each support A, B, and C is adjoined by the other two respective supports and shares with each adjoining support one of three common wall segments 30 extending radially from the shaft 25 at 120° angular spacings from one another. An impact roller 31 is rotatably supported on a vertical axis on each of the common wall segments 30 for cooperating with another one of the impact rollers to precisely position a sliver can disposed on the respective support therebetween. The impact rollers 31 are disposed at a height relative to the sliver cans supported on the can supports such that the impact rollers do not undesirably operate as fulcrums about which the sliver cans may tilt or otherwise behave in an unstable manner during rotation of the turntable 24.

As seen in FIG. 2, the turntable 24 has a particular geometric shape selected to minimize the lateral extent of the turntable during transport of sliver cans by the sliver can transport carriage 16. The circumferential positions of the three sliver cans supported on the can supports A, B, and C define an equilateral triangle, each side of which is tangential to the circumferential positions of two of the sliver cans (e.g., the circle defined by each sliver can when disposed in a can support). Each side of the equilateral triangle defines a perpendicular bisector and each of the common wall segments 30 lies on the perpendicular bisector of a respective side of the equilateral triangle. The perpendicular bisectors of the sides of the equilateral triangle mutually intersect at an intersection point coincident with the axis of the shaft 25. The lateral extent of the turntable 24 transverse to the travel direction of the sliver can transport carriage longitudinally along the spinning machine is equal to twice the length of a segment (e.g., a common wall segment 30) of one of the perpendicular bisectors as measured between the respective triangle side defining the one perpendicular bisector and the intersection point coincident with the axis of the shaft 25.

Three sides of the turntable 24 define the equilateral triangle tangential to the circumferential positions of the sliver cans supported on the can parking spaces A, B, and C. The other three sides of the turntable 24 each lie on a line truncating a respective corner of the equilateral triangle such that each sliver can supported on a can support A, B, and C extends radially further from the axis of the shaft 27 any side of the turntable 24.

As seen in FIG. 2, the particular geometric shape of the turntable 24 ensures that no portion of the turntable exceeds the outward radial extent of the circumferential positions of the sliver cans relative to the axis of the shaft 25. Moreover, the particular geometric shape of the turntable 24 ensures that the turntable can be rotated to a position in which it occupies a relatively narrow extent as measured in a width direction transverse to its direction of travel indicated by the double arrows in FIG. 2 to thereby permit the sliver can transport carriage 16 (and, in particular, its underside frame 17) to be constructed of a relative narrow widthwise extent.

The can support D is located longitudinally in front of the turntable 24 and extends laterally inwardly from one respective lateral side of the transport carriage 16 to at least the longitudinal centerline of the transport carriage.

Figure 3:
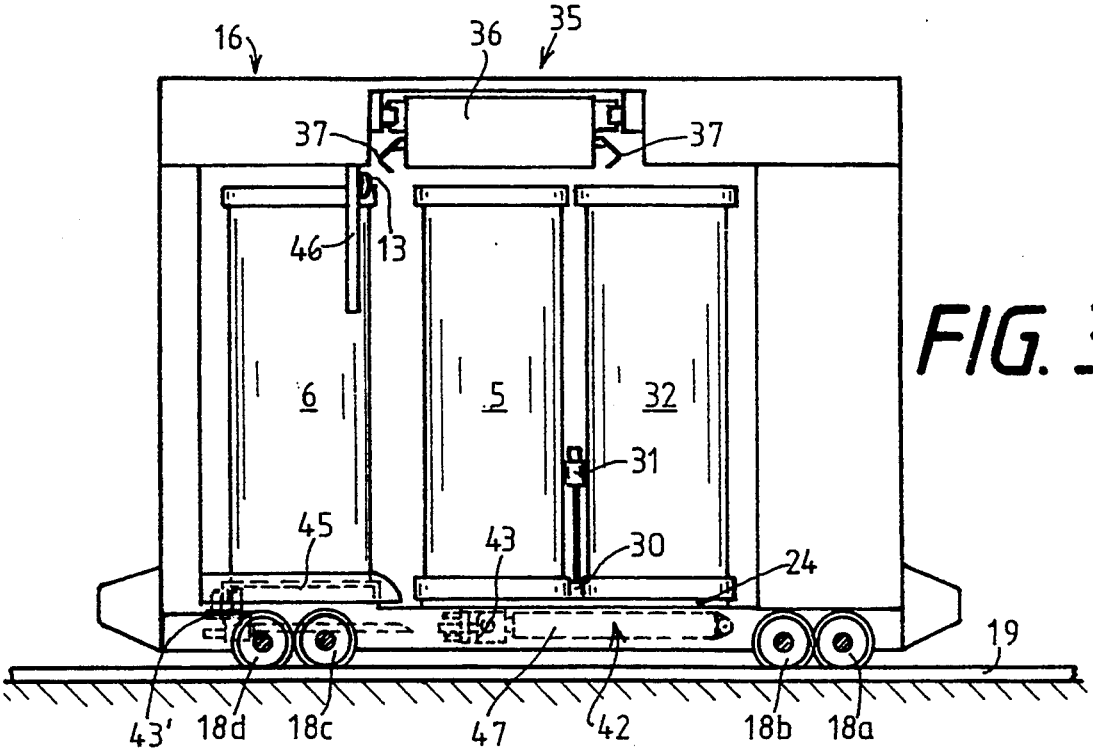
FIG. 3 is a front elevational view of the sliver can transport carriage shown in FIG. 1.

With further regard to the other components of the sliver can transport carriage 16, as seen in FIG. 3, the transport carriage includes a can manipulating assembly 35 for loading and unloading sliver cans between the can supports A, B, and C and a spinning station 1 or another sliver can parking location. The can manipulating assembly 35 includes a telescoping frame 36 having a pair of can grasping arms 37 for selectively grasping and releasing a sliver can. The telescoping frame 36 is normally in a retracted position in which the can grasping arms 37 are disposed diametrically opposite one another relative to a vertical transfer axis which is coincident with the axis of a sliver can supported by the turntable 24 at a can transfer location. As seen in FIGS. 2 and 3, the can transfer position is the position occupied by a sliver can supported by the can support A at the particular rotational disposition of the turntable 24 shown in FIG. 2. The telescoping frame 36 is movable horizontally in a forward or reverse manipulating direction (indicated by the double arrow 38 in FIG. 2) transverse to the direction of travel of the sliver can transport carriage 16.

Figure 8A:
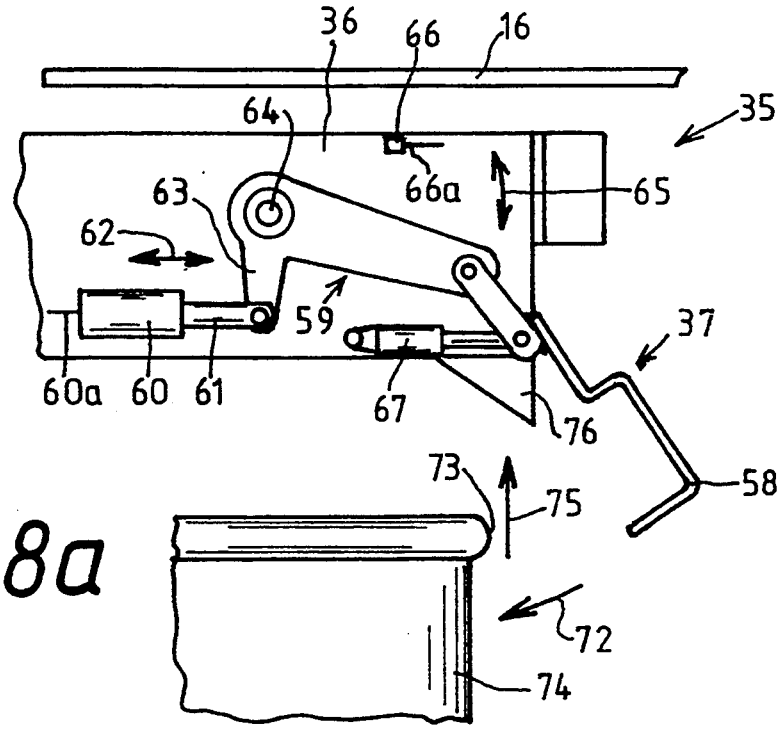
FIG. 8*a* is an enlarged front elevational view of the sliver can transport carriage shown in FIG. 3 and showing a portion of the sliver can gripping assembly thereof in a non-gripping position.
Figure 8B:
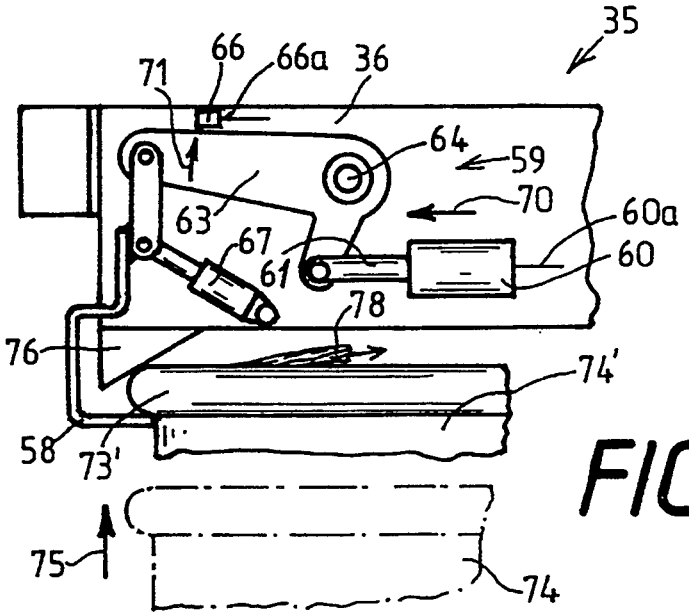
FIG. 8*b* is an enlarged front elevational view of another portion of the sliver can gripping assembly shown in FIG. 8*a* in a can grasping position.

As seen in particular in FIGS. 8*a* and 8*b*, each can grasping arm 37 includes a rigid claw member 58 having an in-turned end for positioning under an upper bead 73 of a sliver can 74 to support the sliver can in cooperation with the in-turned end of the rigid claw member 58 of the other can grasping arm 37. The other end of each claw member 58 is fixedly mounted to one end of a link. The same end of the link is pivotedly mounted to the free end of a piston and cylinder assembly 67 which is pivotedly mounted to the telescoping frame 36.

The other end of the link is pivotedly mounted to one leg 63 of a bell crank 59, which is pivotedly mounted by a pivot 64 to the telescoping frame 36. The other leg of each bell crank 59 is pivotedly mounted to the free end of a piston 61 of a piston and cylinder 60 which is fixedly mounted to the telescoping frame 36. The pair of piston and cylinder assemblies 60 are connected via connectors **60*a* to the control unit 41, as seen in FIG. 2. A limit switch 66 is disposed adjacent the travel path of the one leg 63 of each of the bell cranks 59 and is connected via connector 66*a* to the control unit 41 for indicating the arrival of the one leg 63** of the bell crank at the end of its travel during pivoting travel of the bell crank in a selected pivoting direction.

As seen in FIG. **8*a*, the piston 61 of each of the piston and cylinder assemblies 60 is selectively extendable and retractable in the directions indicated by the double arrow 62 to effect pivoting of the respective bell crank 59 about its pivot 64. Also, each cylinder and piston assembly 67, which may include, for example, a gas pressurized spring, continuously biases the respective claw member 58 in a laterally outward disposition in which the in-turned end of the claw member is disposed laterally outwardly of the circumference of the upper bead 73 of a sliver can 74 positioned under the can manipulating assembly 35**.

In operation, when the sliver can transport carriage 16 is parked adjacent a spinning station 1 or other location for performing a sliver can exchange operation thereat, the telescoping frame 36, which is normally in its retracted position during the travel of the sliver can transport carriage, is either maintained in its retracted position (for grasping a sliver can supported on the rotating turntable 24) or is extended to a position over a sliver can at the spinning station or other location for supplement grasping of the sliver can. The extending and retracting movement of the telescoping frame 36 is controlled by the control unit 41. If, for example, an empty sliver can 5 is to be ultimately transferred from a spinning station 1 to an unoccupied can support on the rotating turntable 24, the telescoping frame 36 is controlled by the control unit 41 to extend to a position in which the telescoping frame is disposed over the empty sliver can 5 with the claw members 58 of the pair of the can grasping arms 37 disposed laterally outwardly and above the empty sliver can 5. The control unit 41 then controls the pair of the cylinder and piston assemblies 60 to extend their respective pistons 61 to thereby effect pivoting of the one leg 63 of each bell crank 59 in a pivot direction such as, for example, the pivot direction indicated by the arrow 71 in FIG. **5*b* in which the one leg 63 of the bell crank pivots into contact with the limit switch 66. The pivoting movement of the legs 63 of each respective bell crank 59 effects both laterally inward and upward movement of the respective claw member 58 due to the linkage arrangement interconnecting the one leg 63 and the claw member 58 and the action of the respective cylinder and piston assembly 67. Accordingly, each of the claw members 58 initially moves laterally inward into contact with the circumference of the sliver can below its upper bead and, thereafter, moves upwardly into engagement with the upper bead to thereby lift the sliver can as well during continued pivoting of the respective bell crank 59**.

Figure 9:
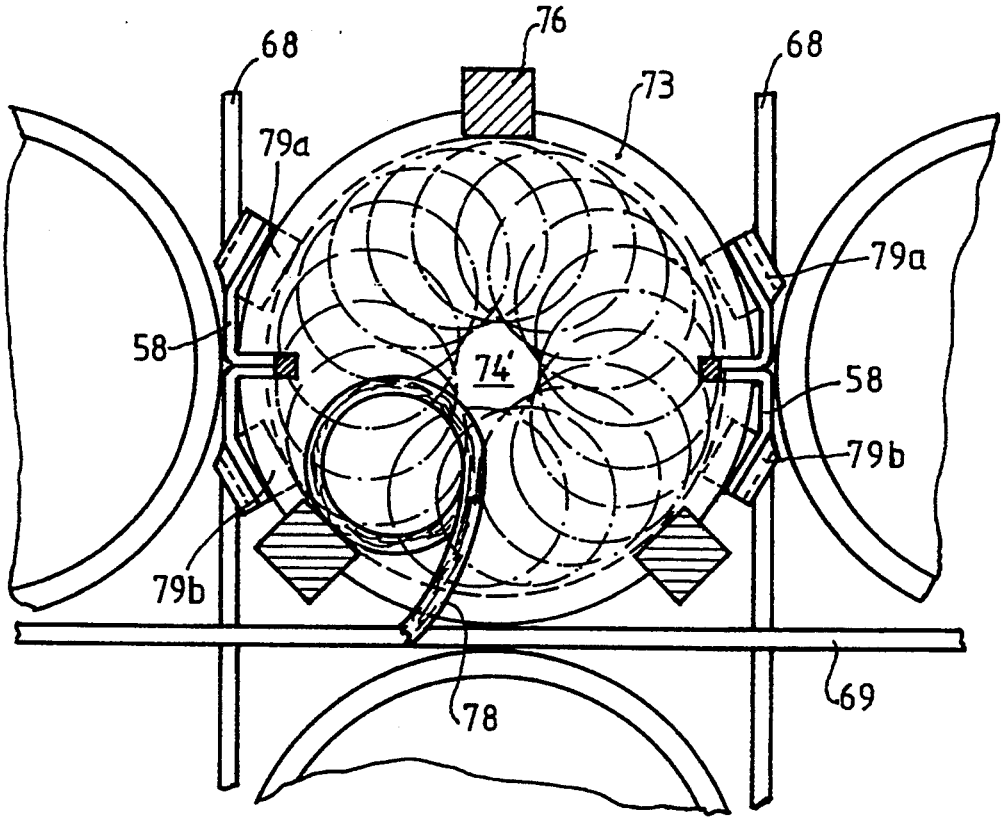
FIG. 9 is a top plan view, in partial horizontal section, of the two portions of the sliver can gripping assembly shown in FIGS. 8*a* and 8*b*.

As seen in FIG. 9, each of the claw members 58 includes a pair of grip fingers **79*a*,79*b* which engage the underside of the upper bead 73 of a sliver can at circumferentially spaced locations thereon to ensure stable grasping of the sliver can by the can manipulating assembly 35**.

In correspondence with the positioning of the fingers **79*a*,79*b* of the pair of the claw members 58 under the upper bead 73 of the empty sliver can, the control unit 41, which has received a signal from the limit switches 66 indicating the completion of the positioning of the claw members 58, controls the telescoping frame 36** to retract with the now engaged empty sliver can has been moved therewith.

Figure 6:
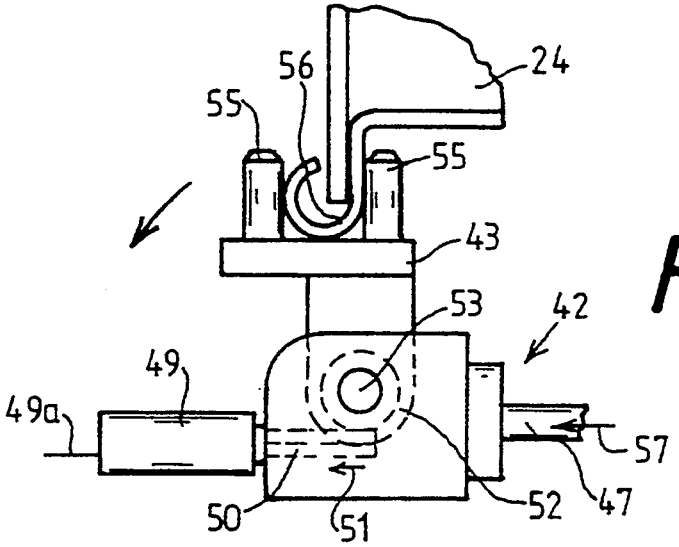
FIG. 6 is an enlarged front elevational view of the finger elements shown in FIG. 5 in their raised position.

As seen in FIG. 9, the respective sliver can 74 engaged by the claw members 58 is lifted upwardly in the direction indicated by the arrow 75 due to the upward movement of the claw members 58. As seen in FIGS. 9 and 6, a plurality of centering components 76 are secured to the underside of the telescoping frame 36 and have inwardly tapering surfaces tapering in an upper direction for engaging the upper bead 73 of a sliver can as it is lifted by the claw members 58 to effect centering of the engaged sliver can relative to a transfer axis. This centering of the sliver can facilitates the disposing of the sliver can in a centered position on a respective can support on the turntable 24. The centering components 76 advantageously center a sliver can engaged by the can manipulating assembly 35 without disturbing any sliver which is, at the same time, being drawn from the sliver can, such as a sliver 78 as seen in FIG. 9. The centering components are positioned at positions offset 120° from one another.

To ensure that the telescoping frame 36 is extended or retracted at a sufficient clearance above any sliver can supported therebelow, the lower front edge 77 of the telescoping frame 36, as seen in FIG. 1, is appropriately constructed to minimize any damage or clamping of sliver with which the edge may come into contact. As seen in FIG. 9, the centering components 76, the claw members 58, and the underside of the telescoping frame 36, are all configured to permit sufficient clearance between the underside of the telescoping frame 36 for a sliver to be drawn out of an engaged sliver can without interference.

As seen in FIG. 2, the telescoping frame 36 can be configured to extend to an opposite lateral side of the transport carriage 16 to grip a sliver can supported at an auxiliary sliver can loading position 80 or to release a sliver can thereonto. In coordination with the gripping or release of a sliver can at the auxiliary sliver can loading position 80 by the can manipulating assembly 35, the control unit 41 controls the rotation of the turntable 24 to position an empty can support at an appropriate angular disposition for receiving a sliver can laterally moved by the can manipulating assembly 35 from the auxiliary sliver can loading position 80 toward the transport carriage 16 or for supporting a full sliver can for subsequent lateral movement to the auxiliary sliver can loading position 80. A transceiver 82 is mounted on the opposite lateral side of the transport carriage 16 and is connected via connector **82*a* to the control unit 41 for providing signals indicating the alignment of the transport carriage 16 at a cam transfer disposition adjacent the auxiliary sliver can loading position 80**.

A transmitter 39 is mounted at each spinning station 1 and is connected via connection **39*a* to a spinning machine control unit (not shown). The transmitter 39 is configured to emit a signal having a supply demand component and alignment component. The sliver can transport carriage 16 includes a receiver 40 mounted on the underside frame 17, as seen in FIGS. 2 and 3, at the same height as the transmitters 39 mounted at the spinning stations 1 and the receiver 40 is connected via a connector 40***a* to the control unit 41. The receiver 40 is operable to receive the signals emitted by the transmitters 39 of those spinning stations 1 at which a sliver can exchange operation is currently due or will be due within a relatively short period of time. The signal received by the receiver 40 is further transmitted to the control unit 41, which controls the drive motor 21 via the connector 21*a* to drive the sliver can transport carriage 16 to each respective spinning station 1 emitting a signal. Through appropriate known signal transmitting and receiving operations between the transmitters 39 and the receiver 40, a signal is transmitted to the control unit 41 indicating that the sliver can transport carriage 16 and the respective spinning station 1 at which a sliver can exchange operation is to be performed are aligned with one another.

Figure 5:
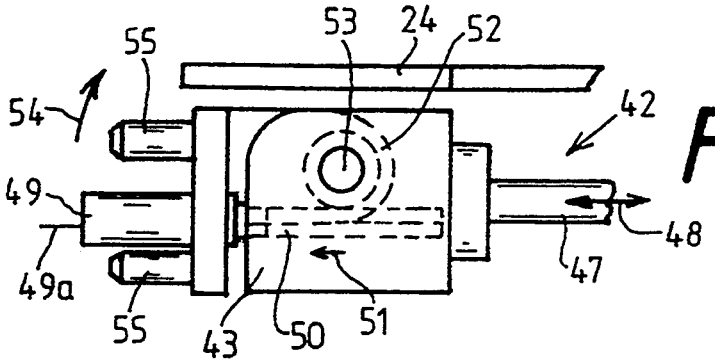
FIG. 5 is an enlarged front elevational view the finger elements of the can shifting assembly of the sliver can transport carriage shown in FIG. 3 and showing the finger elements in their lowermost position.

With reference to FIGS. 2–7, the can shifting assembly 42 comprises a shifter rod 47 which is selectively extendable and retractable in the directions indicated by the double arrow 48 in FIG. 5, by a conventional controlled movement arrangement such as, for example, a pneumatic or hydraulic cylinder operatively connected to the control unit 41 by a connector 42*a*. The shifter rod 47 and its associated cylinder extend parallel to the direction of travel of the sliver can transport carriage 16, as seen in FIG. 2. As seen in FIG. 3, the cylinder is fixedly connected at its closed end to the frame 17 of the sliver can transport carriage 16 and is operable to selectively extend or retract the shifter rod 47. The free end of the shifter rod 47 is secured to the housing of a finger element 43, which includes a plurality of fingers 55 for engaging the lower rounded circumferential bead 56 of a sliver can positioned at the can transfer location such as, for example, the lower circumferential bead 56 of a sliver can as seen in FIG. 6.

Figure 7:
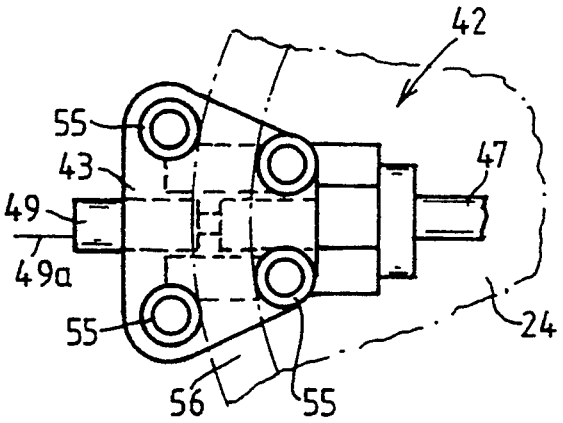
FIG. 7 is a bottom plan view of the finger elements shown in FIG. 6.

The finger element 43 includes a platform pivotally mounted by a pivot 53 to the housing secured at the free end of the shifter rod 47. As seen in FIGS. 6 and 7, the finger element 43 includes four individual fingers 55, a pair of which are positioned for engaging an inner circumferential surface of the circumferential bead 56 of the sliver can and the other pair of which are positioned for engaging an outer surface of the circumferential bead of the sliver can. A platform cylinder and piston assembly 49 includes a cylinder fixedly mounted to the housing of the finger element 43 and a piston 50 having worm gear threading formed thereon for meshingly engaging gear teeth 52 formed on the platform of the finger element 43. The platform cylinder and piston assembly 49 is connected via connector 49*a* to the control unit 41. The worm gear threads of the piston 50 threadingly engage the gear teeth 52 of the platform of the finger element 43 to effect selective pivoting of the platform 43 about the axis of the pivot 53. The platform of the finger element 43 is normally disposed in a non-engaging disposition, as shown in FIG. 5, in which the platform of the finger element has been pivoted to its lowermost position in which the platform does not extend substantially beyond the top of the housing of the finger element 43. Since the housing of the finger element 43 is disposed below the level of the turntable 24, the turntable 24 can be rotated about the axis 25 without interference from the finger element 43 during indexing movement of the can supports. To effect shifting of a sliver can supported on the turntable 24 at the can transfer location to the running can support D, the can shifting assembly 47 is controllably operated by the control unit 41 as follows.

As seen in FIG. 2, a guide rail 45 guides the sliver can as it is shifted into, or out of, the running can parking position D. Also, a longitudinal slot 44, as seen in FIGS. 8 and 4, is formed in the frame 17 for guiding the finger element 43 as the finger element is moved by the shifter rod 42.

Prior to engagement of a sliver can supported at the can transfer location, the shifter rod 47 is normally retracted in its associated cylinder and the platform of the finger element 43 is normally pivoted to its lowermost position as shown in FIG. 5. Once a sliver can has been transferred to the respective an support at the can transfer location by the can manipulating assembly 35, the control unit 41 controls the can shifting assembly 47 to shift the respective sliver can to the running can support D. The control unit 41 controls the extension of the shifter rod 47 and pivoting of the platform of the finger element 43 in the direction shown by the arrow 54 to simultaneously extend the platform of the finger element 43 outwardly beyond the edge of the turntable 24 and to raise the fingers 55 upwardly into engagement with the circumferential bead 56 of the respective sliver can. The lower circumferential bead 56 of the sliver can extends beyond at least a portion of the edge of the can support, such as can be seen with respect to the full sliver can 32 supported at the can support A in FIG. 2, and so the fingers 55 can be raised upwardly past the rotating table 24 to engage the lower circumferential bead 56 of the respective sliver can. The upward pivoting of the platform of the finger element 43 is accomplished by retraction of the piston 50 of the platform cylinder and piston assembly 49 in the direction shown by the arrow 51 in FIG. 5.

As the fingers 55 are raised, one respective pair of the fingers engages the inner circumferential surface of the lower circumferential bead 56 while the other respective pair of the fingers engages the outer surface of the lower circumferential bead, as seen in FIGS. 6 and 7. As the platform of the finger element 43 completes a pivoting movement through an angular displacement of approximately 90°, the fingers 55 have fully engaged the respective inner and outer circumferential surfaces of the lower circumferential bead 56 of the sliver can and the control unit 41 controls the platform cylinder and piston assembly 49 to cease pivoting of the platform of the finger element 43. With the fingers 55 fully engaging the lower circumferential bead 56 of the sliver can, the shifter rod 47 is extended in the direction indicated by the arrow 57 in FIG. 6 until the finger element 43 has been advanced to the position shown by the broken lines 43' in FIG. 3 at which the sliver can engaged by the finger element is fully supported at the running can support D. During this shifting of the sliver can, the sliver in the can continues to be drawn out.

At a later time in the can exchange operation, as described in more detail below with respect to FIG. 10, the respective can support at the can transfer location is empty and the control unit 41 controls the cylinder associated with the shifter rod 47 to effect retraction of the shifter rod with the fingers 55 still in engagement with the lower circumferential bead 56 of the sliver can supported at the running can support D. The retracting movement of the shifter rod 47 effects shifting of the sliver can from the running can support D onto the respective empty can support on the turntable 24 at the can transfer location. The control unit 41 controls the platform cylinder and piston assembly 49 to downwardly pivot the platform of the finger element 43 in correspondence with the completion of the retracting movement of the shifter rod 47. The platform cylinder and piston assembly 49 extends the piston 50 in the direction opposite to the arrow 51 in FIG. 6 to downwardly pivot the platform through an angular displacement of approximately 90° and thereby return the platform to its lower position shown in FIG. 5. As the platform pivots downwardly, the fingers 55 move out of engagement with the lower circumferential bead 56 of the sliver can.

Although the can shifting assembly 42 has been described as including an arrangement for shifting a sliver can in the direction of travel of the transport carriage 16, the present invention also contemplates that other suitable shifting means such as, for example, an endless chain assembly or an overhead can manipulating assembly such as the can manipulating assembly 35, can be provided in lieu of the can shifting assembly 42 for shifting a sliver can between the running can support D and the turntable 24.

Figures 10A, 10B, 10C, 10D, 10E, 10F, 10G, 10H, 10I, 10J, 10K:
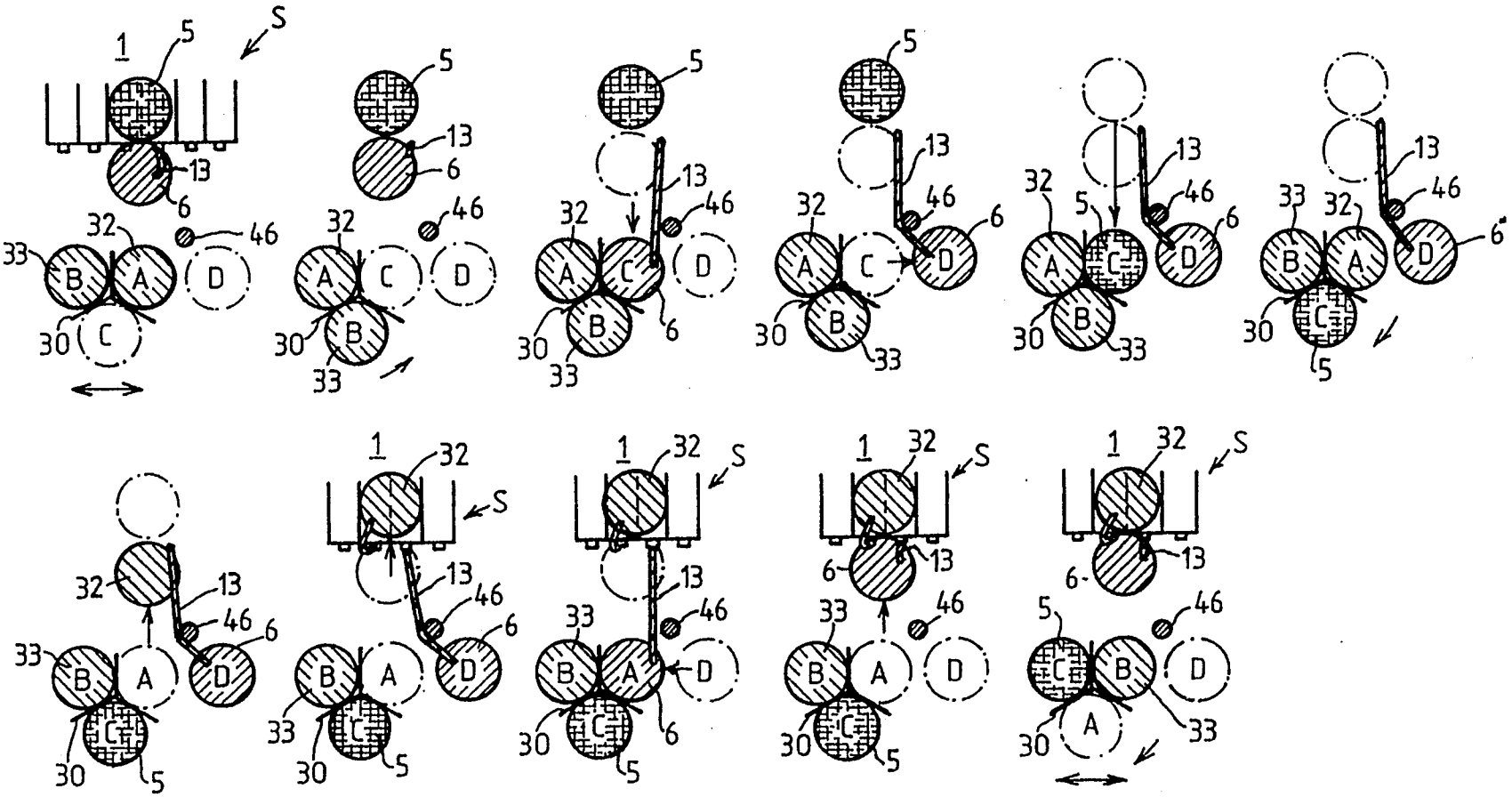
FIGS. 10*a–k* are each a schematic top plan view of the sliver can transport carriage of the present invention and a spinning station during a can exchange operation therebetween.

In FIG. 10, an exemplary operational sequence of the sliver can transport carriage 16 is illustrated in which the transport carriage is operated to supply a full sliver can 32 to a spinning station in replacement of an empty sliver can 5 in the back row thereof. As seen in FIG. 10*a*, the sliver can transport carriage 16 travels longitudinally adjacent the spinning machine S in one of the directions indicated by the double arrow in response to the receipt of a signal from the respective spinning station 1 indicating that one of its sliver cans is, or will shortly become, empty. The sliver can transport carriage 16, which is schematically represented by the common wall segments 30, supports two full sliver cans 32,33 on the can supports A,B, respectively, of the turntable 24 with the can support being initially empty. The full sliver cans 32,33 are aligned one behind the other relative to the direction of travel of the sliver can transport carriage 16. The telescoping frame 36 of the can manipulating assembly 35 is in its retracted position.

While the sliver can 5 in the back row of the spinning station 1 is empty, sliver continues to be drawn from the sliver can 6 in the front row of the spinning station and this still running sliver 13 is still being drawn from the sliver can 6 upon the arrival of the sliver can transport carriage 6 in a can exchange disposition adjacent spinning station 1. In correspondence with the arrival of the sliver can transport carriage 16 at the spinning station 1, the transmitter 39 transmits a signal to the receiver 40 on the transport carriage (as described with respect to FIG. 2) to cause the transport carriage to commence a can exchange operation. Initially, the turntable 24 is rotated in the counterclockwise direction as seen in FIG. 10*b* in an indexing movement which brings the initially empty can support C into coincidence with the can transfer location on the transport carriage.

As seen in FIG. 10*c*, the telescoping frame 36 of the can manipulating assembly 35 is extended toward the sliver can 6 in the front row of the spinning station 1 and the can grasping arms 37 are manipulated in correspondence with the extending movement of the telescoping frame to engage and lift the sliver can 6. In correspondence with the lifting of the sliver can 6 by the can grasping arm 37, the telescoping frame 36 is retracted from its extended position to effect movement of the engaged sliver can 6 to the can transfer location at which the can grasping arms 37 are controlled to release the sliver can 6 onto the can support C. Throughout the engagement, lifting, and release of the sliver can 6, the sliver 13 continues to be drawn from the sliver can into the spin box of the spinning station 1.

As seen in FIG. 10*d*, the next operational step in the can exchange operation involves movement of the sliver can 6 from its supported disposition on the can support C at the can transfer location to the running can support D. The movement of the sliver can 6 from the can support C to the running can support D is effected by the can shifting assembly 42 in a can shifting operation as described previously with respect to FIGS. 3 and 4. Throughout the can shifting operation, the sliver 13 continues to be drawn from the sliver can 6 and, in this regard, the sliver 13 travels over the guide contour 46, which ensures that the sliver travels along a path out of interference with the transport carriage 16 while the sliver can 6 is in supported in the running can support D.

As seen in FIG. 10*e*, in correspondence with the shifting of the sliver can 6 into the running can support D, the telescoping frame 36 is extended from its retracted position and the can grasping arms 37 are controlled in coordination with the extending movement of the telescoping frame 36 to engage the empty sliver can 5 in the back row of the spinning station 1. In correspondence with the lifting of the empty sliver can 5 by the can grasping arms 37, the telescoping frame 36 is retracted with the now lifted empty sliver can 5 being maintained in its lifted position by the can grasping arms 37. The can grasping arms 37 are controlled to release the empty sliver can 5 onto the empty can support C once the telescoping frame 36 has been sufficiently retracted to bring the empty sliver can 5 into coincidence with the can transfer location. The sliver 13 continues to be drawn from the sliver can 6 at the running can support D throughout the engagement, movement, and release of the empty sliver can 5.

As seen in FIG. 10*f*, the turntable 24 is controlled to rotate in an indexing movement to bring the can support A into coincidence with the can transfer location after the empty sliver can 5 has been disposed on the can support C. During this indexing movement, the empty sliver can 5 continues to be supported by the can support C.

As seen in FIG. 10*g*, the next step of the can exchange operation illustrated in FIG. 10 involves engagement and lifting of the full sliver can 32 at the can support A by the can manipulating assembly 35. In correspondence with the lifting of the full sliver can 32, the telescoping frame 36 is extended toward the spinning station 1 to position the full sliver can 32 at a location relative to the spin box of the spinning station at which sliver from the full sliver can is introduced into the spin box. In this regard, the introduction of sliver from the full sliver can 32 into the spin box can be effected by a conventional sliver introduction process involving the use of a controllable sliver grasping component, such as illustrated in German Offenlegungsschrift 26 46 313. The present invention contemplates that the extending movement of the telescoping frame 36 can be controlled as necessary to position the full sliver can 32 at any selected intermediate position between the position of the back row of the spinning station 1 and the transport carriage 16 during the sliver introduction process.

As seen in FIG. 10*h*, during the introduction of sliver from the full sliver can 32 into a spin box of the spinning station 1, the sliver can 13 continue to be drawn from the sliver can 6 supported at the running can support D.

As seen in FIG. 10*i*, in correspondence with the completion of the movement of the full sliver can 32 into the back row of the spinning station 1, the can shifting assembly 42 is controlled to shift the sliver can 6 from the running can support D into the now empty support A.

As seen in FIG. 10(*j*), in correspondence with the shifting of the full sliver can 6 onto the can support A at the can transfer location, the can manipulating assembly is controlled to move the sliver can 6 from the can transfer location on the transport carriage 16 to the front row of the spinning station 1. This movement of the sliver can 6 is accomplished by engagement and lifting of the sliver can by the can grasping arms 37, subsequent telescoping movement of the telescoping frame 36, and release of the sliver can 6 by the can grasping arms 7 at the front row of the spinning station 1. Throughout out the movement of the sliver can 6 during this step of the can exchange process, the sliver 13 continues to be drawn from the sliver can.

As seen in FIG. 10*k*, in correspondence with the completion of movement of the sliver can 6 into the front row of the spinning station 1, the telescoping frame 36 is retracted to its retracted position on the transport carriage in preparation for further travel of the transport carriage and the turntable 24 is rotated in a clockwise direction in an indexing movement to index the now empty can parking position A from the an transfer location to the standby location; to move the can support C from the standby location to the ready location; and to move the can support D into the can transfer location. This indexing movement of turntable 24 ensures that the full sliver can 33 at the can support B and the empty sliver can 5 at the can support C are aligned one behind the other relative to the direction of travel of the transport carriage 16. The sliver can transport carriage 16 then travels to the next spinning station 1 requiring a can exchange operation.

A can exchange operation in which an empty sliver can is exchanged from the front row of a spinning station 1 follows in similar manner to the can exchange operation just described with respect to FIG. 10, except that no sliver can is shifted onto the running can support D. Instead, the empty sliver can in the front row of the respective spinning station 1 is transferred to the respective empty can support coincident with the can transfer location and the turntable 24 is subsequently rotated in an indexing movement to move the respective full sliver can supported at the ready location into the can transfer location for transfer of the full sliver can to the front row of the spinning station.

Once the full sliver can 33 is subsequently exchanged for an empty sliver can at another spinning station 1, the sliver can transport carriage 16 now supports two empty sliver cans (in the can supports B and C) with the other can support (A) being empty. Since the sliver can transport carriage 16 no longer has any full sliver cans with which to perform a sliver can exchange operation, the transport carriage can be directed to another location such as, for example, a sliver can refill location, at which the empty sliver cans on the transport carriage can be exchanged for full sliver cans to be supplied to the spinning stations 1.

Although the sliver can transport carriage 16 has been described with respect to a configuration in which sliver cans transported by the sliver carriage are loaded and unloaded on one side of the transport carriage, the present invention also contemplates, as seen in FIG. 2, that the sliver can transport carriage 16 can be configured as desired to load and unload sliver cans at the opposite lateral side of the transport carriage. For example, a sliver can positioned at a transfer position 80 can be loaded at the opposite lateral side of the sliver can transport carriage 16 into the selected one of the can supports A, B, and C disposed at the respective can transfer position associated with the opposite lateral side of the transport carriage or, alternatively, a sliver can positioned at the can transfer position on the opposite lateral side of the transport carriage can be transferred to the sliver can position 80. Additionally, if desired, the sliver can transport carriage 16 can be configured to selectively load or unload sliver cans at either one of the lateral sides of the transport carriage. In this situation, the transport carriage is preferably provided with an additional receiver 82 mounted on the underside frame 17 and connected via connector 82*a* to the control unit 41 for cooperating with the transmitters 39 disposed along the side of the respective spinning machine between which sliver cans are to be exchanged at the opposite lateral side of the transport carriage.

It will therefore be readily understood by those persons skilled in the art that the present invention is susceptible of broad utility and application. Many embodiments and adaptations of the present invention other than those herein described, as well as many variations, modifications and equivalent arrangements will be apparent from or reasonably suggested by the present invention and the foregoing description thereof, without departing from the substance or scope of the present invention. Accordingly, while the present invention has been described herein in detail in relation to its preferred embodiment, it is to be understood that this disclosure is only illustrative and exemplary of the present invention and is made merely for purposes of providing a full and enabling disclosure of the invention. The foregoing disclosure is not intended or to be construed to limit the present invention or otherwise to exclude any such other embodiments, adaptations, variations, modifications and equivalent arrangements, the present invention being limited only by the claims appended hereto and the equivalents thereof.

I claim:

1. Apparatus for transporting full sliver cans to the spinning stations of a textile spinning machine for exchange of full sliver cans for empty sliver cans at the spinning stations, the textile spinning machine having a longitudinal edge along which the spinning stations are serially located and the spinning stations each having a back row position for supporting a sliver can and a front row position for supporting another sliver can laterally intermediate the back row position of the spinning station and the longitudinal edge of the textile spinning machine, the spinning machine being operational to draw sliver simultaneously from a can at the front row position and a can at the back row position into two adjacent spinning stations, apparatus comprising:

a can transport carriage movable in a direction of travel to and between the spinning stations, the can transport carriage including means forming a plurality of can supports, each for supporting a nonrunning sliver can from which no sliver is being drawn thereon, means for indexing movement of at least some of the can supports with respect to the carriage to sequentially position each indexed can support at a can transfer location with respect to the carriage at which can transfer location a can is transferred between the can support and the textile spinning machine during a can exchange operation, means for supporting a running sliver can from which sliver continues to be drawn at a running sliver can location, said running sliver can support means being separate from said indexing means and said nonrunning can supports, means for transferring a sliver can from at least a selected one of the front and back row positions at a spinning station to the can transfer location on the can transport carriage, and means for transferring a running can from the can transfer location to said running can location on said running can support, said running can support being operable to support a running sliver can transferred to the transport carriage for the continuous drawing of sliver from the running sliver can during indexing of cans on said carriage and during a can exchange operation in which a full sliver can supported on the can transport carriage is transferred to a spinning station.

2. Apparatus for transporting full sliver cans according to claim 1 wherein the can supports forming means includes means forming three can supports at equal angular spacings of 120° from one another relative to an axis transverse to the direction of travel of the can transport carriage and its lateral extent and the indexing movement means includes means for rotating the three equally angularly spaced can supports about the axis.

3. Apparatus for transporting full sliver cans according to claim 1 wherein the running can support is disposed beyond the other can supports relative to the direction of travel of the can transport carriage.

4. Apparatus for transporting full sliver cans according to claim 3 wherein the can supports forming means includes means forming three can supports at equal angular spacings of 120° from one another relative to an axis transverse to the direction of travel of the can transport carriage and its lateral extent, the indexing movement means includes means for rotating the equally angularly spaced three can supports about the axis to sequentially position each of the three can supports at the can transfer location, a standby location, and a ready location from which the respective can support thereat is indexed into the can transfer location, and the can transfer location and the ready location are arranged such that two sliver cans supported at these two locations and a running can supported at the running can support are substantially aligned with one another in the direction of travel of the can transport carriage.

5. Apparatus for transporting full sliver cans according to claim 3 and further comprising a can manipulating assembly having a selectively extendable and retractable frame and a pair of gripping elements mounted to the frame for gripping a sliver can, at least one of the gripping elements being movable between a can gripping position in which it cooperates with the other gripping element to grip a sliver can and a can release position in which it cooperates with the other gripping element to release a gripped sliver can, the frame being extendable in a direction generally transverse to the direction of travel of the can transport carriage to position the gripping elements laterally outwardly of one side of the transport carriage for selective release or gripping of a sliver can.

6. Apparatus for transporting full sliver cans according to claim 5 wherein the can manipulating assembly includes means for extending the frame laterally outwardly of the transport carriage on a side thereof opposite the one side for selectively gripping of a sliver can by the gripping elements supported at a sliver can loading location or releasing a sliver can onto the sliver can loading location and for retraction of the frame to a position in which the gripping elements are operable to selectively grip a sliver can supported on a can support or release a sliver can onto a can support.

7. Apparatus for transporting full sliver cans according to claim 1 and further comprising a can manipulating assembly having a selectively extendable and retractable frame and a pair of gripping elements mounted to the frame for gripping a sliver can, at least one of the gripping elements being movable between a can gripping position in which it cooperates with the other gripping element to grip a sliver can and a can release position in which it cooperates with the other gripping element to release a gripped sliver can, the frame being extendable in a direction generally transverse to the direction of travel of the can transport carriage to position the gripping elements laterally outwardly of one side of the transport carriage for selective release or gripping of a sliver can.

8. Apparatus for transporting full sliver cans according to claim 7 wherein each sliver can includes an upper circumferential bead of a greater radius than the body of the sliver can and the can manipulating assembly includes means for moving the ends of the gripping elements to respective circumferentially spaced positions radially inwardly of and below the upper bead of a sliver can and for raising the gripping elements to thereby lift the sliver can.

9. Apparatus for transporting full sliver cans according to claim 7 wherein the can manipulating assembly is movable between a spinning station and the sliver can loading location.

10. Apparatus for transporting full sliver cans according to claim 9 wherein the can manipulating assembly includes means for extending the frame laterally outwardly of the transport carriage on one side thereof to grip or release a sliver can at one of the back and front row positions of a spinning station and to extend the frame to the opposite lateral side of the transport carriage to grip or release a sliver can supported at a sliver can loading location.

11. Apparatus for transporting full sliver cans according to claim 1 wherein the can transport carriage includes an assembly for shifting a sliver can between the running can support and the respective can support at the can transfer location.

12. Apparatus for transporting full sliver cans according to claim 9 wherein the can transport carriage includes means for guiding sliver being drawn from a running sliver can supported at the running can support, the guiding means guiding the sliver to travel in a predetermined path between the can transport carriage and the spinning station.

13. Apparatus for transporting full sliver cans according to claim 1 wherein the can transport carriage includes a centerline, the can transfer location is located to one lateral side of the centerline and the running can support is located laterally of the centerline to the same lateral side as the can transfer location.

14. Method of exchanging a sliver can at a spinning station of a textile spinning machine for a full sliver can transported to the spinning station by a sliver can transport carriage, the sliver can transport carriage traveling longitudinally along the one longitudinal edge of the textile spinning machine and the spinning station including a back row position for supporting a first sliver can from which sliver is drawn and a front row position for supporting a second sliver can from which sliver is drawn simultaneously with sliver drawn from the first can, the second can being disposed laterally intermediate the back row position and the longitudinal edge of the textile machine comprising:

providing the transport carriage with a plurality of can supports, means for indexing movement of at least some of the can supports with respect to the carriage and a running can support separate from said indexed can supports;

transferring a running sliver can from the front row position of the spinning station to said running can support without interruption of the drawing of sliver therefrom;

transferring a sliver can from the back row position of the spinning station to the sliver can transport carriage;

transferring a full sliver can from the sliver can transport carriage to the back row position of the spinning station; and returning the running sliver can transferred from the front row position to the front row position.

* * * * *